US012157983B2

(12) United States Patent
Träskelin et al.

(10) Patent No.: US 12,157,983 B2
(45) Date of Patent: Dec. 3, 2024

(54) PILE AND METHOD FOR INSTALLING A PILE

(71) Applicant: Elomatic Oy, Turku (FI)

(72) Inventors: Olavi Träskelin, Pori (FI); Antti Ajosmäki, Pori (FI); Sakari Oja, Pori (FI)

(73) Assignee: ELOMATIC OY, Turku (FI)

( * ) Notice: Subject to any disclaimer, the term of this patent is extended or adjusted under 35 U.S.C. 154(b) by 279 days.

(21) Appl. No.: 17/626,277

(22) PCT Filed: Jul. 22, 2020

(86) PCT No.: PCT/FI2020/050500

§ 371 (c)(1),
(2) Date: Jan. 11, 2022

(87) PCT Pub. No.: WO2021/014052

PCT Pub. Date: Jan. 28, 2021

(65) Prior Publication Data

US 2022/0290394 A1 Sep. 15, 2022

(30) Foreign Application Priority Data

Jul. 24, 2019 (FI) ..... 20195650

(51) Int. Cl.
*E02D 5/28* (2006.01)
*E02D 5/54* (2006.01)
(Continued)

(52) U.S. Cl.
CPC ..... *E02D 5/285* (2013.01); *E02D 5/54* (2013.01); *E02D 7/18* (2013.01); *E02D 7/24* (2013.01); *E02D 7/26* (2013.01)

(58) Field of Classification Search
CPC .. E02D 5/285; E02D 5/54; E02D 7/24; E02B 2017/0078
See application file for complete search history.

(56) References Cited

U.S. PATENT DOCUMENTS 4,086,866 A * 5/1978 Nixon ..... B63B 21/27 114/295
7,399,143 B2 * 7/2008 van Zandwijk ..... E02D 7/24 405/248
(Continued)

FOREIGN PATENT DOCUMENTS

CN 102373711 A 3/2012
CN 103628479 A 3/2014
(Continued)

OTHER PUBLICATIONS

Chinese Office Action received for CN Application No. 202080053387.0 on Mar. 28, 2023, 17 pgs.
(Continued)

*Primary Examiner* — Janine M Kreck
(74) *Attorney, Agent, or Firm* — Merchant & Gould P.C.

(57) ABSTRACT

A pile (100) includes a first elongated hollow body (101) having a first end and a second end, the first end being closed by an end member (103) provided with an opening (104). The pile (100) includes a second elongated hollow body (102) having a first end and a second end, the second elongated hollow body (102) being arranged inside the first elongated hollow body (101) so that the first end of the second elongated hollow body (102) extends through the opening (104) and is attached to the end member (103). A method is for installing a pile (100) into the ground.

4 Claims, 2 Drawing Sheets

(51) Int. Cl.

| | |
|---|---|
| ***E02D 7/18*** | (2006.01) |
| ***E02D 7/24*** | (2006.01) |
| ***E02D 7/26*** | (2006.01) |

(56) References Cited

U.S. PATENT DOCUMENTS

| | | | | |
|---|---|---|---|---|
| 11,446,715 | B2 * | 9/2022 | Jacobsen | E02F 3/9262 |
| 2017/0275844 | A1 * | 9/2017 | Yoon | E02D 7/02 |

FOREIGN PATENT DOCUMENTS

| | | | |
|---|---|---|---|
| CN | 105951826 | A | 9/2016 |
| CN | 106223312 | A | 12/2016 |
| EP | 0962596 | A1 | 12/1999 |
| JP | 2014047532 | A | 3/2014 |
| KR | 101125048 | B1 | 3/2012 |
| KR | 20130009348 | A | 1/2013 |
| KR | 101452185 | B1 | 10/2014 |
| KR | 101746592 | B1 | 6/2017 |
| WO | 2013/081455 | A1 | 6/2013 |
| WO | 2018014608 | A1 | 1/2018 |

OTHER PUBLICATIONS

PCT International Search Report for PCT Application No. PCT/FI2020/050500 mailed Oct. 16, 2020 (4 pages).
PCT IWritten Opinion for PCT Application No. PCT/FI2020/050500 mailed Oct. 16, 2020 (5 pages).
Finnish Search Report for FI Application No. 20195650 mailed Jan. 28, 2020 (1 page).

* cited by examiner

PILE AND METHOD FOR INSTALLING A PILE

CROSS-REFERENCE TO RELATED APPLICATIONS

This application is a National Stage Application of PCT/FI2020/050500, filed 22 Jul. 2020, which claims benefit of Ser. No. 20/195,650, filed 24 Jul. 2019 in Finland, and which applications are incorporated herein by reference. To the extent appropriate, a claim of priority is made to each of the above disclosed applications.

TECHNICAL FIELD OF THE INVENTION

The present invention relates to a pile and a method for installing a pile according to the preambles of the appended independent claims. The invention also relates to a pile system and a pile wall.

BACKGROUND OF THE INVENTION

Various piles are known in the prior art to provide support for a structure by transferring its load through compressible strata or water onto layers of soil or rock that have sufficient bearing capacity and suitable settlement characteristics. Piles are typically formed by long, columnar elements made from steel or reinforced concrete. Percussion drivers, hydraulic drivers, vibratory drivers and rotary augers are typically used to install piles into the ground.

Piles may be classified by their basic design function or by their method of construction. An end-bearing pile develops most of its friction at the toe of the pile, bearing on a hard layer. The end-bearing pile transmits load directly to firm strata and receives lateral restraint from subsoil. A friction pile develops most of the pile-bearing capacity by shear stresses along the sides of the pile and is suitable where harder layers are too deep. The friction pile transmits load to surrounding soil by friction between the surface of the pile and soil. A driven pile is driven, jacked, vibrated or screwed into the ground, displacing the material around the pile outwards and downwards instead of removing it. The driven pile is often used in offshore applications. A bored pile removes soil to form a hole for the pile which is poured in situ. The bored pile is used primarily in cohesive subsoils for the formation of friction piles and when forming pile foundations close to existing buildings. A screw pile has a helix near the pile toe so it can be screwed into the ground.

A problem associated with known piles is that they are difficult and time-consuming to install into the ground. Another problem associated with the known piles is that they are difficult or even impossible to remove from the ground. Yet another problem of the known piles is that they are not versatile, but instead can only be used in some specific applications.

OBJECTIVES OF THE INVENTION

It is the main objective of the present invention to reduce or even eliminate the prior art problems presented above.

It is an objective of the present invention to provide a pile that is easy and quick to install into the ground. It is a further objective of the invention to provide a pile that can be easily removed from the ground. It is yet a further objective of the invention to provide a pile that is versatile, allowing it to be used in various applications.

It is also an objective of the present invention to provide an easy and quick system and method for installing a pile into the ground.

In order to realise the above-mentioned objectives, the pile and the method according to the invention are characterised by what is presented in the characterising portions of the appended independent claims. Advantageous embodiments of the invention are described in the dependent claims.

DESCRIPTION OF THE INVENTION

A pile according to the invention comprises a first elongated hollow body having a first end and a second end, the first end being closed by an end member provided with an opening, and a second elongated hollow body having a first end and a second end, the second elongated hollow body being arranged inside the first elongated hollow body so that the first end of the second elongated hollow body extends through the opening and is attached to the end member.

The pile according to the invention has two elongated hollow bodies inside each other. The first elongated hollow body forms the outer body and the second elongated hollow body the inner body of the pile. Preferably, the first and second elongated hollow bodies are essentially parallel with each other and have essentially the same length. Preferably, the second elongated hollow body is arranged con-centrically with the first elongated hollow body.

The first elongated hollow body is preferably tubular and has either a circular or rectangular cross section. The first elongated hollow body can be a pipe, a tube or a stiffened shell. The first end of the first elongated hollow body is closed by the end member, which comprises the opening through which the first end of the second elongated hollow body passes. The end member is preferably attached inside the first end of the first elongated hollow body. The end member is attached to the first and second elongated hollow bodies in a watertight manner. The end member is preferably convergent towards the point where the end member is attached to the second elongated hollow body. The second end of the first elongated hollow body can be open. Alternatively, the second end of the first elongated hollow body can be closed by another end member provided with an opening through which the second end of the second elongated hollow body is arranged to extend. The second elongated hollow body is preferably attached to this end member. After the pile has been installed into the ground, the second ends of the first and second elongated hollow bodies can be hermetically closed by a cover, which prevents material from passing into and out of the pile. The wall thickness of the first elongated hollow body can be, for example, 10-100 mm.

The second elongated hollow body is preferably tubular and has a circular cross section. The second elongated hollow body can be a pipe or a tube. The first end of the second elongated hollow body is open allowing soil to be conveyed through the second elongated hollow body when the pile is installed into the ground. The second end of the second elongated hollow body is open, but it can be closed after the pile has been installed into the ground. The wall thickness of the second elongated hollow body can be, for example, 5-50 mm.

The pile according to the invention is a columnar element, which can be made of steel, stainless steel, titanium, concrete, reinforced plastics or other durable materials. The pile can be installed or driven into the ground. The pile can be installed on dry land or into the bottom of water, such as into a seabed. The pile can be installed into the seabed so that its upper end is either above or below the sea surface. The pile can have a modular structure, wherein the pile is formed of a plurality of pile sections attached sequentially to each other. The length of the pile can be, for example, less than 200 m. Preferably, the length of the pile is 20-100 m. The diameter of the pile can be, for example, 2-10 m.

The pile according to the invention can be installed into the ground as follows. First, the pile is arranged or lowered in a vertical orientation on the ground so that the first ends of the elongated hollow bodies are towards the ground. Then, the soil under the lower end of the pile is dredged with a dredge pump that is attached to the first end of the second elongated hollow body, and the dredged soil is removed through the second elongated hollow body. The space between the first elongated hollow body and the second elongated hollow body can be filled with the removed soil or other suitable material through the upper end of the pile. As the soil is removed from underneath the lower end of the pile, the pile is drawn into the ground. The soil is dredged and removed until the pile is at a desired depth in the ground. When needed, the pile can be removed from the ground, for example, by pumping water through the second elongated hollow body underneath the lower end of the pile. As the water is pumped underneath the lower end of the pile, the pile starts to rise from the ground.

The pile according to the invention can be used to provide support for a structure by transferring its load through compressible strata or water onto layers of soil or rock that have sufficient bearing capacity and suitable settlement characteristics. The friction between the first elongated hollow body and the soil may be taken into account in determination of the bearing capacity of the pile. The pile can be used, for example, to support docks, quays and wharves.

The piles according to the invention can be attached together to form a pile wall. In the pile wall, the piles are attached at their sides to each other. The piles can be attached to each other before or after they have been installed into the ground. The number of the piles in the pile wall can be, for example, 2-50. The pile wall can be arranged to a closed shape, such as to a circular form. The diameter of the closed shape can be, for example, 5-100 m.

An advantage of the pile according to the invention is that it is easy and quick to install into the ground. Another advantage of the pile according to the invention is that it can be easily removed from the ground. Yet another advantage of the pile according to the invention is that it can be reused. Yet another advantage of the pile according to the invention is that it is versatile, allowing it to be used in various applications, such as offshore applications.

According to an embodiment of the invention the second end of the first elongated hollow body is open allowing a space between the first elongated hollow body and the second elongated hollow body to be filled with ballast. The space can be filled during the installation of the pile into the ground. The space can be filled, for example, with the dredged soil, gravel, stones, sand, water, cement or barite slurry, or with any combination of these. An advantage of the space between the first elongated hollow body and the second elongated hollow body is that it can be filled with ballast during the installation of the pile into the ground which facilitates the pile installation.

According to an embodiment of the invention the pile comprises a plurality of outer supports attached to an outer surface of the first elongated hollow body. The outer supports may comprise plates, arms or rods. The outer supports may extend perpendicularly outwards from the outer surface of the first elongated hollow body. The outer supports are preferably attached to a position where the outer supports become at least partly embedded into the ground when the pile is installed. Preferably, the outer supports are arranged symmetrically around the first elongated hollow body and at the same distance from the second end of the first elongated hollow body. The number of the outer supports can be, for example, 2-10. An advantage of the outer supports is that they protect against the lateral forces due to wind and/or waves.

According to an embodiment of the invention the pile comprises a plurality of inner supports attached between an inner surface of the first elongated hollow body and an outer surface of the second elongated hollow body. The inner supports may comprise plates, arms or rods. The inner supports may extend perpendicularly between the inner surface of the first elongated hollow body and the outer surface of the second elongated hollow body. The inner supports can be arranged at various locations along the length of the pile. At each location, a plurality of inner supports can be arranged symmetrically around the second elongated hollow body. The number of the inner supports can be, for example, 2-50, 50-1000 or 1000-3000. An advantage of the inner supports is that they increase the rigidity of the pile.

According to an embodiment of the invention the end member comprises a conical portion. The conical portion can be arranged so that it opens away from the pile. An advantage of the conical portion is that it directs the soil towards the first end of the second elongated hollow body.

According to an embodiment of the invention the pile comprises heat transferring means arranged inside the second elongated hollow body for heating and/or cooling the pile. The heat transferring means are arranged inside the second elongated hollow body after the pile has been installed into the ground. The heat transferring means may comprise heat pipes for transferring heat. An advantage of the heat transferring means is that they enable to keep the temperature of the pile in a desired temperature range. For example, with the heat transferring means the ground and/or the water surrounding the pile can be prevented from freezing or the ground and/or the water surrounding the pile can be artificially frozen.

The present invention also relates to a pile system for installing a pile into the ground. The pile system according to the invention comprises a pile according to the invention, a dredge pump attached to the first end of the second elongated hollow body for dredging soil, and a riser pipe arranged inside the second elongated hollow body for carrying the dredged soil, a first end of the riser pipe being attached to the dredge pump.

The dredge pump is releasably attached to the second elongated hollow body so that it can be removed through the second elongated hollow body after the pile has been installed into the ground. The dredge pump is attached to the first end of the second elongated hollow body with a connector that provides a watertight connection between the dredge pump and the second elongated hollow body. The riser pipe carries the dredged soil through the second elongated hollow body. A second end of the riser pipe can be attached to a tank outside the pile for receiving the dredged soil. The riser pipe can be made of steel, stainless steel, or any other suitable material. The riser pipe can be a reinforced hose.

The pile can be installed into the ground as follows. First, the pile is arranged or lowered in a vertical orientation on the ground so that the first ends of the elongated hollow bodies are towards the ground. Then, the soil under the lower end of the pile is dredged with the dredge pump, and the dredged soil is removed through the riser pipe. As the soil is removed from underneath the lower end of the pile, the pile is drawn into the ground. The soil is dredged and removed until the pile is at a desired depth in the ground. Finally, the dredge pump and the riser pipe can be removed from the pile.

An advantage of the pile system according to the invention is that the pile can be easily and quickly installed into the ground.

According to an embodiment of the invention the dredge pump comprises a cutter unit for loosening the soil. The cutter unit may comprise rotating cutting or stirring blades driven for example by a hydraulic motor. An advantage of the cutter unit is that it facilitates the installation of the pile into the ground.

According to an embodiment of the invention the dredge pump comprises a water spraying unit for fluidising the soil. The water spraying unit may comprise nozzles to distribute pressurised water. An advantage of the water spraying unit is that it facilitates the installation of the pile into the ground.

According to an embodiment of the invention the pile system comprises a plurality of water spraying pipes for fluidising the soil. The water spraying pipes may comprise nozzles to distribute pressurised water. An advantage of the water spraying pipes is that they facilitate the installation of the pile into the ground.

According to an embodiment of the invention the pile system comprises vibrating means attached to the first elongated hollow body or the second elongated hollow body for vibrating the pile. The vibrating means can comprise an eccentric-type vibrator. The vibrating means can be configured to vibrate the pile at a frequency of 0.5-50 Hz. An advantage of the vibrating means is that they facilitate the installation of the pile into the ground.

The present invention also relates to a pile wall. The pile wall according to the invention comprises a plurality of piles according to the invention attached to one another. The piles are attached to one another at their sides. The piles can be attached to one another, for example, by welding or by interlocking sections. The piles can be attached to one another before or after they have been installed into the ground. The number of piles in the pile wall can be, for example, 2-50.

According to an embodiment of the invention the plurality of piles is arranged in a circular form. The diameter of the circular form can be, for example, 5-100 m.

The present invention also relates to a method for installing a pile according to the invention into the ground. The method according to the invention comprises arranging the pile in a vertical orientation on the ground, using a dredge pump attached to the first end of the second elongated hollow body to dredge soil, and using a riser pipe arranged inside the second elongated hollow body to carry the dredged soil. The pile is arranged on the ground so that the first ends of the elongated hollow bodies are towards the ground. The dredge pump is used to dredge the soil under the lower end of the pile. The dredged soil is drawn from the dredge pump through the riser pipe that is arranged inside the second elongated hollow body. As the soil is removed from underneath the lower end of the pile, the pile is drawn into the ground. The soil is dredged and removed until the pile is at a desired depth in the ground.

An advantage of the method according to the invention is that the pile can be easily and quickly installed into the ground.

According to an embodiment of the invention the method comprises vibrating the pile. The pile can be vibrated at a frequency of 0.5-50 Hz. The pile can be vibrated with an eccentric-type vibrator that is attached to the first elongated hollow body or the second elongated hollow body. An advantage of vibrating the pile is that it facilitates the installation of the pile into the ground.

According to an embodiment of the invention the method comprises filling a space between the first elongated hollow body and the second elongated hollow body with ballast. The space can be filled during the installation of the pile into the ground. The space between the first elongated hollow body and the second elongated hollow body can be filled with the removed soil through the upper end of the pile. Alternatively, the space can be filled, for example, with gravel, stones, sand, water, cement or barite slurry, or with any combination of these. An advantage of filling the space between the first elongated hollow body and the second elongated hollow body with ballast during the installation of the pile into the ground is that it facilitates the pile installation.

According to an embodiment of the invention the method comprises removing the dredge pump and the riser pipe from the pile and sealing the second ends of the first elongated hollow body and the second elongated hollow body with a cover. The cover prevents any material from passing into and out of the pile.

According to an embodiment of the invention the method comprises arranging heat transferring means inside the second elongated hollow body. The heat transferring means are arranged inside the second elongated hollow body after the pile has been installed into the ground. The heat transferring means are configured to heat and/or cool the pile. An advantage of the heat transferring means is that they enable to keep the temperature of the pile and eventually its surrounding in a desired temperature range.

The exemplary embodiments of the invention presented in this text are not interpreted to pose limitations to the applicability of the appended claims. The verb "to comprise" is used in this text as an open limitation that does not exclude the existence of also unrecited features. The features recited in the dependent claims are mutually freely combinable unless otherwise explicitly stated.

The exemplary embodiments presented in this text and their advantages relate by applicable parts to the pile, the pile system, the pile wall, and the method according to the invention, even though this is not always separately mentioned.

DETAILED DESCRIPTION OF THE DRAWINGS

The same reference signs are used of the same or like components in different embodiments.

Figure 1:
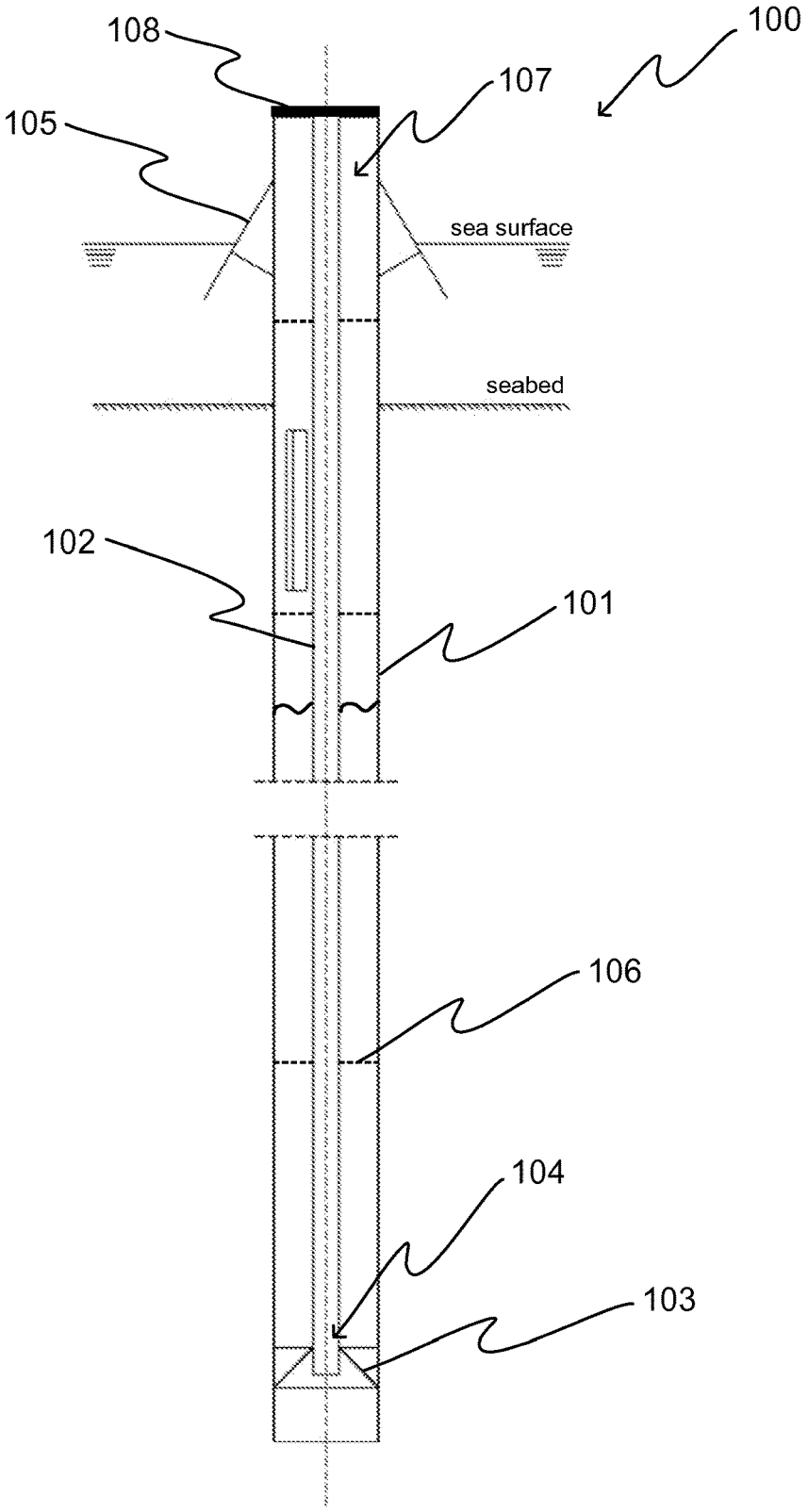
FIG. 1 illustrates a cross sectional view of a pile according to an embodiment of the invention.

FIG. 1 illustrates a cross sectional view of a pile according to an embodiment of the invention. The pile 100 has been installed in a vertical orientation into the seabed so that its upper end is above the sea surface.

The pile 100 comprises two elongated hollow bodies 101, 102 inside each other. The first (i.e. outer) elongated hollow body 101 is closed at its first end by a conical end member 103 that is provided with an opening 104. The conical end member 103 is attached inside the first end of the first elongated hollow body 101. The second (i.e. inner) elongated hollow body 102 is arranged inside the first elongated hollow body 101 in such a manner that a first end of the second elongated hollow body 102 extends through the opening 104 and is attached to the conical end member 103.

The pile 100 comprises outer supports 105, which are attached to an outer surface of the first elongated hollow body 101. The outer supports 105 extend perpendicularly outwards from the outer surface of the first elongated hollow body 101 and are arranged at the same distance from the upper end of the pile 100. The pile 100 also comprises inner supports 106 attached between an inner surface of the first elongated hollow body 101 and an outer surface of the second elongated hollow body 102. The inner supports 106 extend perpendicularly between the inner surface of the first elongated hollow body 101 and the outer surface of the second elongated hollow body 102 and are arranged at various locations along the length of the pile 100.

The space 107 between the first elongated hollow body 101 and the second elongated hollow body 102 has been filled with dredged soil during the installation of the pile 100 into the seabed. After the installation of the pile 100, the upper end of the pile 100 has been closed by a cover 108, which prevents material from passing into and out of the pile 100.

Figure 2:
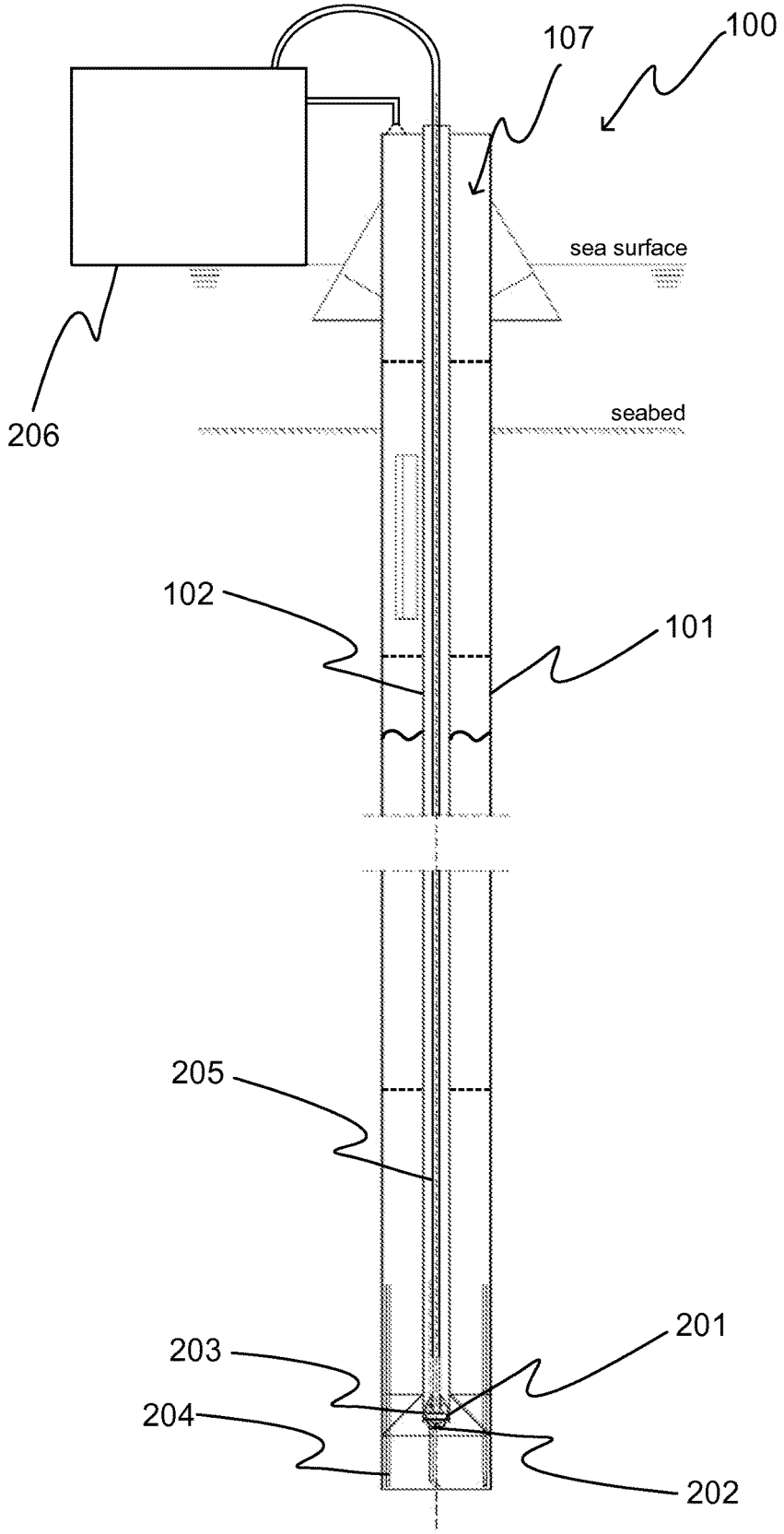
FIG. 2 illustrates a cross sectional view of a pile system according to an embodiment of the invention.

FIG. 2 illustrates a cross sectional view of a pile system according to an embodiment of the invention. In FIG. 2, the pile according to FIG. 1 is installed into the seabed.

The pile system comprises a dredge pump 201 that is attached to the first end of the second elongated hollow body 102. The dredge pump 201 is used for dredging soil under the lower end of the pile 100. The dredge pump 201 is releasably attached to the second elongated hollow body 102 so that it can be removed through the second elongated hollow body 102 after the pile 100 has been installed into the seabed. The dredge pump 201 comprises a cutter unit 202 for loosening the soil and a water spraying unit 203 for fluidising the soil. The cutter unit 202 and the water spraying unit 203 facilitate the dredging and thus the installation of the pile 100 into the seabed. The pile system also comprises water spraying pipes 204 for fluidising the soil.

The pile system comprises a riser pipe 205 arranged inside the second elongated hollow body 102 for carrying the dredged soil. A first end of the riser pipe 205 is attached to the dredge pump 201 and a second end of the riser pipe 205 is attached to a tank 206 that receives the dredged soil. From the tank 206, the dredged soil is pumped into the space 107 between the first elongated hollow body 101 and the second elongated hollow body 102 to work as ballast. The soil can be processed in the tank 206 before it is pumped into the pile 100.

As the soil under the lower end of the pile 100 is dredged with the dredge pump 201, and the dredged soil is removed through the riser pipe 205, the pile 100 is drawn into the seabed. The soil is dredged and removed until the pile 100 is at a desired depth in the seabed.

Only advantageous exemplary embodiments of the invention are described in the figures. It is clear to a person skilled in the art that the invention is not restricted only to the examples presented above, but the invention may vary within the limits of the claims presented hereafter. Some possible embodiments of the invention are described in the dependent claims, and they are not to be considered to re-strict the scope of protection of the invention as such.

The invention claimed is:

1. A pile system, wherein the pile system comprises:
- a pile comprising:
  - a first elongated hollow body having a first end and a second end, the first end being closed by an end member provided with an opening, and
  - a second elongated hollow body having a first end and a second end, the second elongated hollow body being arranged inside the first elongated hollow body so that the first end of the second elongated hollow body extends through the opening and is attached to the end member;
- a dredge pump attached to the first end of the second elongated hollow body for dredging soil, and
- a riser pipe arranged inside the second elongated hollow body for carrying the dredged soil, a first end of the riser pipe being attached to the dredge pump.

2. The pile system according to claim 1, wherein the dredge pump comprises a cutter unit for loosening the soil.

3. The pile system according to claim 1, the dredge pump comprises a water spraying unit for fluidising the soil.

4. The pile system according to claim 1, wherein the pile system comprises a vibrator attached to the first elongated hollow body or the second elongated hollow body for vibrating the pile.

* * * * *